US005604993A

United States Patent [19]

Auckerman

[11] Patent Number: 5,604,993

[45] Date of Patent: Feb. 25, 1997

[54] GLOVE DRYING DEVICES AND METHODS

[76] Inventor: Irmgard G. Auckerman, 3041 Kaiser Dr., #G, Santa Clara, Calif. 95051

[21] Appl. No.: 580,174

[22] Filed: Dec. 28, 1995

[51] Int. Cl.[6] ..... F26B 25/00

[52] U.S. Cl. ..... 34/104; 34/239; 219/211; 392/382

[58] Field of Search ..... 34/104, 239; 219/211; 392/382, 383, 384

[56] References Cited

U.S. PATENT DOCUMENTS

| | | | |
|---|---|---|---|
| 2,035,094 | 3/1936 | Palicki | 18/41 |
| 2,783,925 | 3/1957 | Ross | 223/78 |
| 3,096,008 | 7/1963 | Schumacher | 223/78 |
| 3,409,142 | 11/1968 | Mechaneck | 211/13 |
| 3,477,622 | 11/1969 | Appelt | 223/78 |
| 3,486,670 | 12/1969 | Sutton | 223/78 |
| 3,653,561 | 4/1972 | Shields . | |
| 3,917,266 | 11/1975 | Kiey | 273/32 A |
| 4,018,382 | 4/1977 | DiCuya | 223/78 |
| 4,084,733 | 4/1978 | Perlmutter | 223/78 |
| 4,209,913 | 7/1980 | Wallin et al. | 34/21 |
| 4,565,287 | 1/1986 | Rede et al. | 206/213 |
| 4,638,915 | 1/1987 | Kaplan | 211/13 |
| 4,689,897 | 9/1987 | Marsalona | 34/103 |
| 4,697,724 | 10/1987 | Pitcher | 223/78 |
| 4,991,756 | 2/1991 | Benjamin | 223/72 |
| 5,011,053 | 4/1991 | Davies | 223/78 |
| 5,117,565 | 6/1992 | Willenbacher, Jr. | 34/103 |
| 5,125,169 | 6/1992 | Bader | 34/103 |
| 5,199,188 | 4/1993 | Franz | 34/105 |
| 5,406,717 | 4/1995 | Dofka | 34/104 |

*Primary Examiner*—Henry A. Bennett
*Assistant Examiner*—Dinnatia Doster
*Attorney, Agent, or Firm*—Law Office of Albert J. Dalhuisen

[57] ABSTRACT

The present invention provides devices and methods for drying the inside surfaces of gloves. The glove drying devices include a perforated hollow drying form in the shape of a hand. A tube is mounted to the inside of the drying form in order to improve the air flow into the interior of the form. A heating means is provided for mounting inside the tube in order to heat the air which flows into the drying form and to enhance the air flow.

15 Claims, 3 Drawing Sheets

GLOVE DRYING DEVICES AND METHODS

FIELD OF THE INVENTION

The present invention relates to devices and methods for drying of gloves. More particularly, the invention relates to drying of gloves on perforated drying forms. Still more particularly, the invention relates to drying the inside surfaces of gloves on perforated drying forms utilizing ambient or heated air flow through the interior of the form.

BACKGROUND OF THE INVENTION

Gloves are frequently used for a variety of reasons, such as, outdoor recreation, as protective wear in health care, commercial food handling or industry and for doing household chores such as dish washing. Moisture released by the skin of the user's hand wets the inside of the glove, making it slippery and unpleasant to wear. Moisture collecting on the inside of the glove can result in growing harmful microorganisms on the inside surface of the glove, which could lead to skin infections. Users of gloves which are not permeable to moisture vapor, such as, for example, rubber or plastic gloves find that they frequently need to change to dry gloves in order to avoid the unpleasant feeling of a wet glove.

The problems described above are well known in the art and various devices and methods have been designed by others attempting to solve these problems. For example, U.S. Pat. No. 5,406,717 (Dofka, 1995) discloses a drying rack for utility gloves including hollow telescoping tubes with adjustment holes and spread ring discs. Pylons situated on the basis of a drain basin serve as bases for the telescoping tubes. The spread ring discs spread open the inside of gloves. U.S. Pat. No. 5,199,188 (Franz, 1993) discloses a method and apparatus for drying footwear and handwear including a blower assembly which directs heated or ambient air into a glove placed on a handwear holder. U.S. Pat. No. 5,117,565 (Willenbacher, Jr. 1992) discloses a glove drying apparatus including a hollow wire mesh form configured as a human hand. Drying air can be directed into the form through air conduits.

U.S. Pat. No. 4,209,913 (Wallin et al, 1980) discloses a method and device for drying gloves including a perforated glove form shaped to resemble a human hand. A means is provided to direct a flow of heated air into the perforated form. U.S. Pat. No. 4,084,733 (Perlmutter, 1978) discloses a glove form for drying and shaping gloves consisting of a unitary thin sheet plastic element having springiness. The form is ribbed or scalloped longitudinally. U.S. Pat. No. 2,035,094 (Palicki, 1935) discloses a work glove form. The form is hollow and is provided with a plurality of perforations.

Known glove drying devices and methods, as exemplified by the above referenced patents, do not provide an optimal design for the drying of the inside surfaces of gloves. For example, prior art devices which direct ambient or heated air into a glove form generally have no provision for circulating the air through the inside of the form such that the air is removed from the form. Also, mechanical devices which are used to direct air into a form tend to be bulky and noisy when in use. Prior art hollow drying forms having a plurality of perforations offer a drying surface only at the perforations, while the areas of the glove surface which remain in direct contact with the surface of the solid form are not exposed to air and are thus likely to dry only at a very slow rate or not at all.

Wire mesh forms typically provide a greater drying surface than hollow perforated forms. Wire mesh forms however are prone to oxidation under repeated high humidity conditions, generally they are more easily damaged than hollow perforated forms. Also, wire mesh forms when damaged may have one or more sharp points from broken wires which can puncture a glove which is dried on the form.

Accordingly, the need exist for improved glove drying devices and methods to more effectively dry the inside of gloves.

SUMMARY OF THE INVENTION

The present invention provides novel devices and methods for drying the inside surfaces of gloves.

In one embodiment a hollow perforated glove drying form, generally in the shape of a hand, is provided with a hollow tube mounted to the inside of the form such that a substantial length of the tube extends outside the form.

In another embodiment a hollow perforated glove drying form, generally in the shape of a hand, is provided with a hollow tube mounted to the inside of the form such that the tube extends outside of the form wherein the tube is provided with a non-mechanical heat source.

In yet another embodiment a hollow perforated glove drying form, generally in the shape of a hand and having a tube mounted to the inside of form, is provided with a stand for supporting the form in a drying position.

In yet another embodiment a hollow perforated glove drying form, generally in the shape of a hand and having a tube mounted to the inside of the form has an exterior surface which is textured.

DETAILED DESCRIPTION OF THE INVENTION

While describing the invention and its embodiments, certain terminology will be utilized for the sake of clarity. It is intended that such terminology include not only the recited embodiments but all equivalents which perform substantially the same function, in substantially the same manner to achieve substantially the same result.

The present invention utilizes perforated plastic drying forms. Plastic materials suitable for the drying forms of the current invention included thermoplastics as well as thermoset plastics. Examples of suitable thermoplastics include, but are not limited to: acrylonitrile-butadiene-styrene copolymer, polycarbonate, polyethylene, polypropylene, polystyrene and polyvinyl chloride. Examples of suitable thermoset plastics include, but are not limited to: epoxy and polyester. The forms can be manufactured from plastic raw materials using methods which are well known to those skilled in the art, such as, for example, injection molding, blow molding, thermo forming and lay-up molding.

Figure 1:
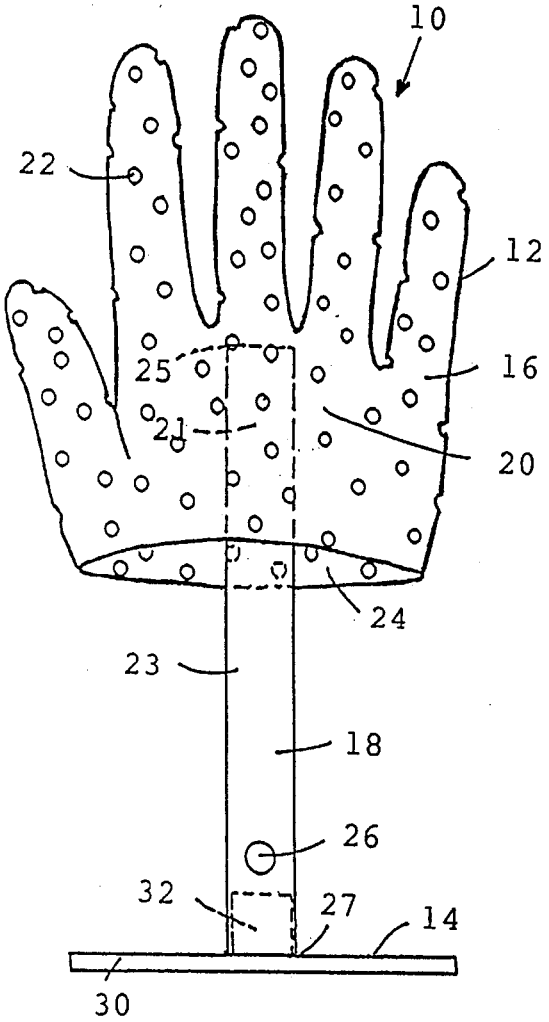
FIG. 1 is a schematic front elevation view illustrating a glove drying device of the present invention.

One embodiment of the present invention is illustrated in FIG. 1, showing glove drying device 10 which includes a glove drying member 12 and a support 14. Glove drying member 12 comprises drying form 16 and tube 18. Drying form 16 is configured substantially as a human hand having a thumb or thumb portion, four fingers or finger portions and a palm section or palm portion 20. Form 16 is hollow and is made of a rigid plastic material. The thickness of the plastic is not critical providing the thickness is sufficient to support a wet glove without substantially deforming the plastic. A preferred thickness range is from about 1/32 inch to about 3/32 inch. Form 16 is perforated with a plurality of holes 22. At least 30% of the surface of form 16 consists of holes. Preferably, at least 50% of the surface of form 16 consists of holes. The diameter of the holes is not critical, but a preferred diameter range is from about 1/16 inch to about 3/8 inch. Form 16 has an open end 24.

Figure 3:
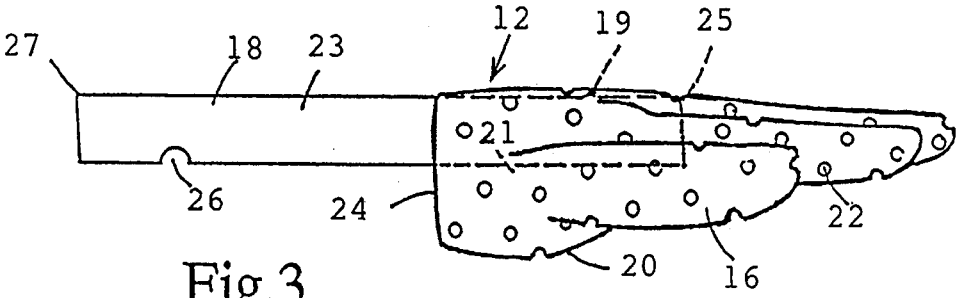
FIG. 3 is a schematic side elevation view of a detail of the glove drying device illustrated in FIG. 1.

Tube 18 is attached to the inside surface of drying form 16 having a first length 21 which extends inside the form and a second length 23 extending a predetermined length from open end 24 of form 16, preferably at least 2 inches, more preferably at least 6 inches. Generally, the predetermined length of second length 23 should be such that the glove does not touch the base which supports the glove drying member. Thus, a glove which does not extend beyond the palm portion can be dried on a glove drying device having a relatively short second length, such as 2 inches. First end 25 of tube 18 is preferably positioned in close proximity to the fingers. Tube 18 can be attached to form 16 using a variety of attachment means such as: screws, rivets and adhesive bonding. A preferred attachment means is adhesive bonding. An example of a suitable type of adhesive includes adhesive compositions comprising a hardenable epoxy resin. Tube 18 can be attached to either the inside of the palm section, or to the inside of the back of the hand section. The latter is the preferred attachment region, such as at position 19 (FIG. 3). Tube 18 is provided with at least one hole 26 having a predetermined diameter which is preferably at least about 1/8 inch. The center of hole 26 is positioned a predetermined distance X from tube second end 27.

Support 14 includes a base 30 and a post 32 which is mounted approximately perpendicular on base 30. The dimensions of base 30 are not critical, provided the base has sufficient stability to support a drying device with a glove. Post 32 has a longitudinal axis which is positioned centrally through the post. This post is configured to fit inside tube 18. When tube 18 is placed on post 32, hole 26 in tube 18 is positioned in close proximity to post 32, without being obstructed by this post. It will be understood that one base, such as base 30 shown in FIG. 1, may have a plurality of posts mounted thereon in order to support a plurality of drying members on one base. Optionally, provision can be made for attaching a name plate or a name label to the base in order to identify the user of the device.

Figure 2:
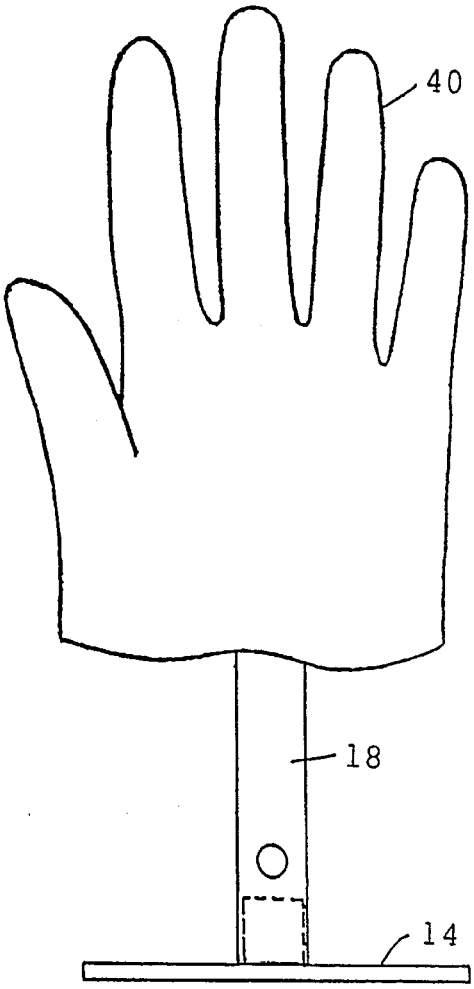
FIG. 2 is a schematic front elevation view of the glove drying device illustrated in FIG. 1, wherein a glove is placed on the drying device.

FIG. 2 shows a glove 40 which is placed on form 16 in order to dry the inside of the glove.

Figure 4:
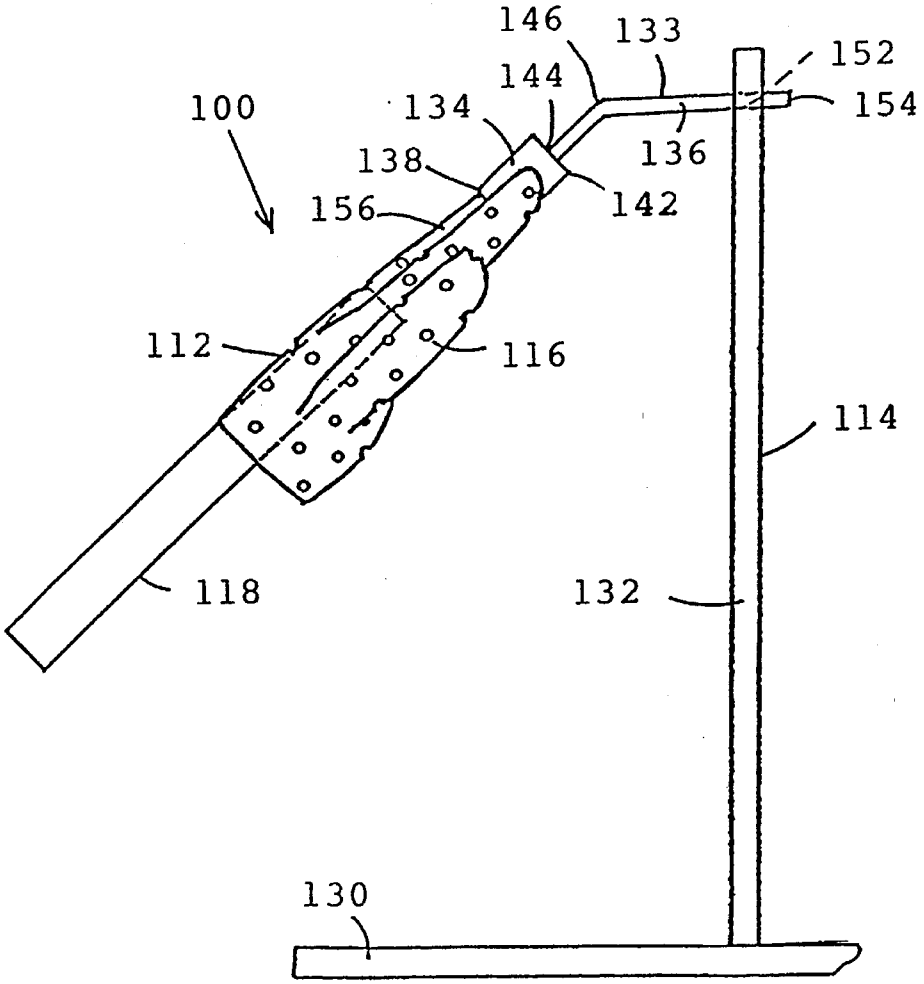
FIG. 4 is a schematic front elevation view illustrating an alternate glove drying device of the present invention.

An alternate embodiment of the present invention is shown in FIG. 4, illustrating glove drying device 100 which includes glove drying member 112 comprising drying form 116 and tube 118. Member 112 is similar to glove drying member 12 (FIGS. 1 and 3) except that member 112 does not require a hole in tube 118. Drying form 116 has a plurality of holes 122 similar to holes 22 of form 16.

Support 114 (FIG. 4) includes a base 130, a post 132 which is mounted approximately perpendicular on base 130 and a finger holder 133 having a tubular member 134 and a rod member 136. A first end 138 of tubular member 134 is open while a second end 142 is rigidly attached to rod member 136. The method of attachment between these two members is not critical provided that it is a rigid attachment. There are many commonly known techniques for attaching a rod to a tube. For example, end 144 of rod member 136 can be fitted tightly in a hole in a cylindrical plug which is tightly fitted in end 142 of tubular member 134. Suitable materials for rod member 136 include metals and plastics.

Figure 5:
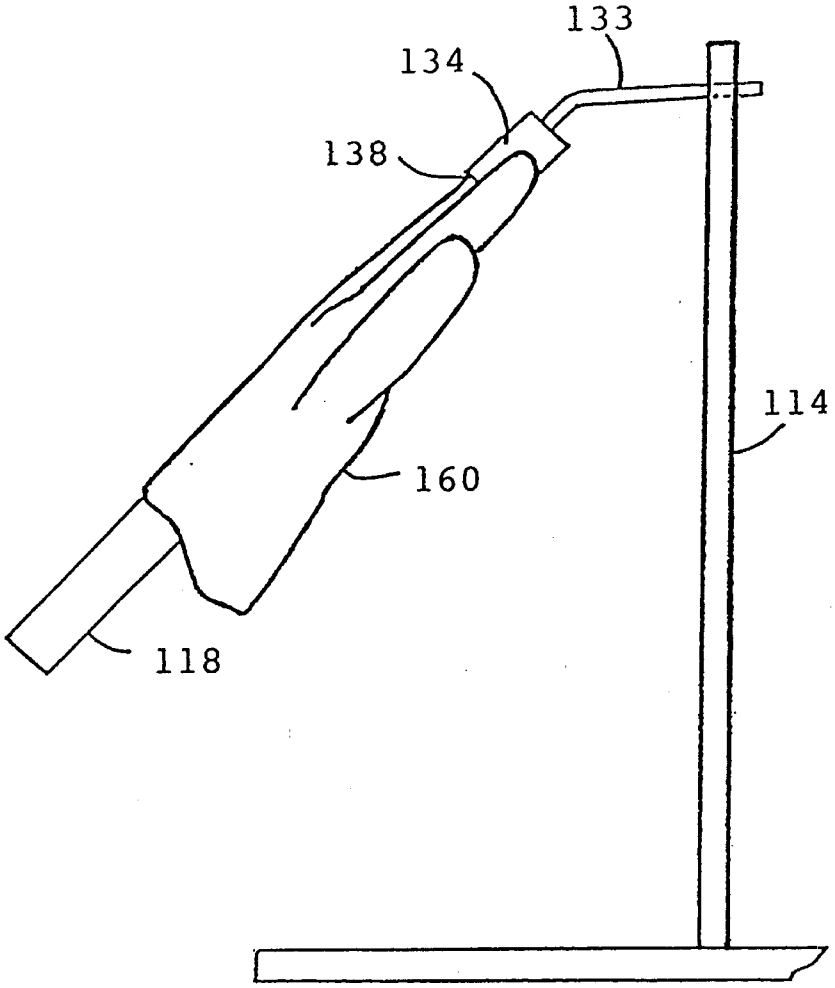
FIG. 5 is a schematic front elevation view of the glove drying device illustrated in FIG. 4, wherein a glove is placed on the drying device.

Rod member 136 (FIG. 4) has an elbow section 146 which has a predetermined angle ranging from about 90 degrees to about 150 degrees, preferably ranging from about 120 degrees to about 135 degrees. Post 132 is provided with a hole 152, through which end 154 of rod member 133 is inserted. Open end 138 of tubular member 134 is adapted for receiving the end of a finger 156 of drying form 116 when a glove 160 is placed on the drying member, as shown in FIG. 5. It will be understood that one support such as support 114 may have a plurality of holes, such as hole 152, in order to support a plurality of drying members, such as drying member 112.

Figure 6:
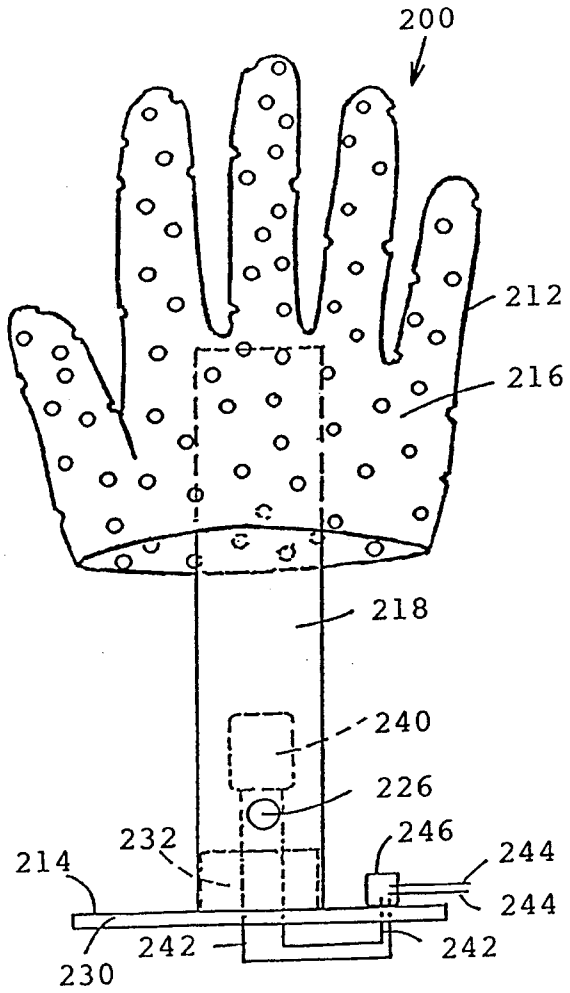
FIG. 6 is a schematic front elevation view illustrating an alternate glove drying device of the present invention.

FIG. 6 illustrates glove drying device 200 which is an additional alternate embodiment of the present invention. Glove drying device 200 includes glove drying member 212 and a support 214. Glove drying member 212 comprises drying form 216 and tube 218 wherein form 216 and tube 218 are similar to form 16 and tube 18 respectively of drying device 10 (FIGS. 1 and 3).

Support 214 of drying device 200 (FIG. 6) comprises a base 230, a post 232, a heating element 240, electrical wiring 242 and 244, electrical on-off switch 246 and a mounting means (not shown) for mounting heating element 240 on post 232. Post 232 is mounted substantially perpendicular to base 230 and is configured to fit inside tube 218. Heating element 240 includes an electrical heating means such as a heating element similar to those used for example in hair dryers or a light bulb mounted in an appropriate light bulb fixture (not shown). The mounting means (not shown) for heating element 240 includes conventional mounting means such as posts and brackets. Heating element 240 is preferably positioned above hole 226 of tube 218. Hole 226 is positioned in close proximity to post 232 without being obstructed by the post. Electrical wiring 242 connects the heating element to the switch while electrical wiring 244 connects switch 246 to an electrical power source (not shown).

Figure 7:
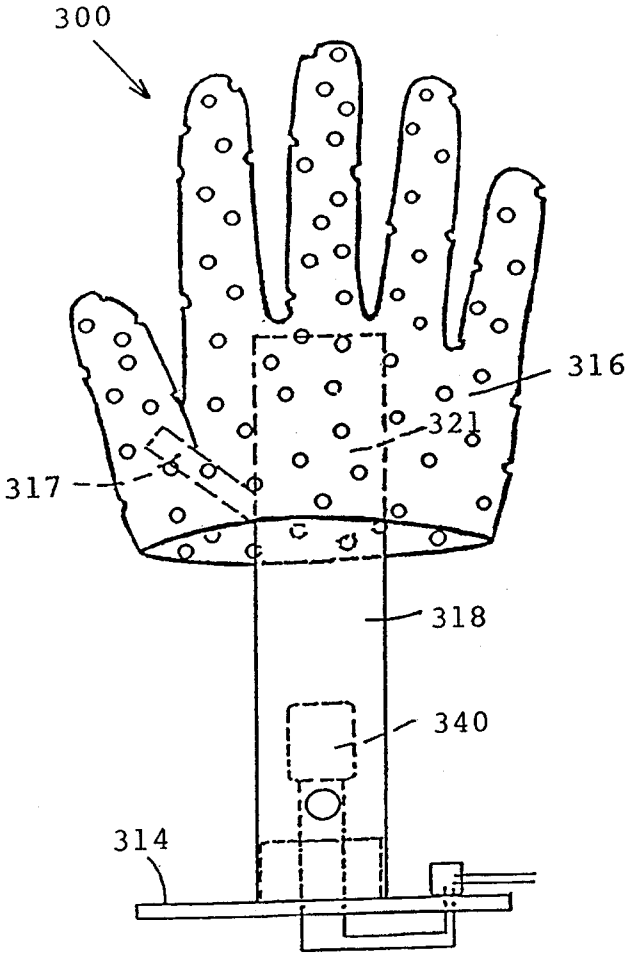
FIG. 7 is a schematic front elevation view illustrating an alternate glove drying device of the present invention.

An alternate embodiment of the present invention is shown in FIG. 7 which illustrates glove drying device 300. This includes a drying form 316, a tube 318, a base 314 and a heating element 340. Drying device 300 is similar to device 200 (FIG. 6) except that tube 318 is provided with a pipe 317 which branches off from the first length 32 1 of tube 318 into the thumb of the drying form such that pipe 317 communicates with tube 318. Similarly, other pipe sections can be provided into one or more fingers of heated as well as non-heated glove drying devices of the present invention.

Alternate embodiments (not shown) include glove drying devices of the present invention, such as devices 10 (FIGS. 1 and 3) and 200 (FIG. 6), wherein the tube is not provided with a hole. Instead, the base and the post have one or more connecting through-holes which communicate with the inside of the tube when the tube is placed on the post. These through-holes provide air passages into the second length of the tube which are equivalent to the air passage which is provided through holes 26 and 226 in devices 10 and 200 respectively.

Additional embodiments (not shown) include glove drying devices similar to device 10 (FIGS. 1 and 3), device 100 (FIG. 4) and device 200 (FIG. 6) having drying forms wherein the exterior surface is textured such that the surface is not smooth. Textured surfaces of the drying forms of the current invention include: (1) a plurality of grooves along the exterior surface, (2) a plurality of protrusions, such as molded protrusions, on the exterior surface and (3) an abraded exterior surface such as results from treatment of the plastic surface with an abrasive medium such as sand paper.

Additional embodiments (not shown) provide for a coating of powder, such as talcum, on the exterior surface of the drying forms of the present invention, by dipping the form in a container with powder. The powder coated forms can be utilized to provide a powder coating on the inside of the gloves by placing the glove on the powder coated form. This technique can be utilized to absorb traces of moisture which can be present on the inside surfaces of gloves.

The inside surfaces of gloves are dried with the various glove drying devices of the present invention using the following methods. For example, a glove 40 can be placed on a drying member 12 of glove drying device 10, see FIGS. 1 and 2. Tube 18 is placed on post 32 thereby positioning the glove in an upright position wherein the open end of glove 40 is facing base 30 of support 14. Base 30 is placed on an approximately horizontal surface, whereby tube 18 is placed in an approximately vertical position. The vertical upright placement of the glove will cause liquid which has collected on the inside surface to drain away from the glove through gravitational flow. The open end of the glove and tube 18 provide air circulation inside drying form 16. Air circulating inside form 16 accesses the inside surface of glove 40 through perforations 22, thereby causing the inside surface of glove 40 to dry.

FIGS. 4 and 5 illustrate another method for drying gloves according to the present invention. Glove 160 is placed on a drying member 112 of glove drying device 100. The gloved tip of a finger of drying member 112 is inserted in open end 138 of finger holder 133. End 154 of finger holder 133 is inserted in hole 152 of support 114 such that tube 118 of drying member 112 points towards base 130, thus placing the glove in a position which allows liquids to drain from the inside of the glove through gravitational flow. The open end of the glove, and tube 118, provide air circulation inside glove form 116, causing the inside surface of the glove to dry through perforations 122.

The generally tapered configuration of finger tips of the fingers of drying form 116 permits a substantial size range of finger thickness dimensions to fit inside a predetermined diameter of open end 138 of tubular member 134. The inside rim of open end 138 presses the glove into intimate contact with the drying form at this contact area which might reduce the drying rate at that area. This however, is a very limited area due to the tapered shape of the finger tip.

Device 200 depicted in FIG. 6 illustrates yet another method for drying the inside surfaces of gloves. A glove is placed on drying member 212 as described in connection with FIGS. 1 and 2. Post 232 is inserted into the open end of tube 218. Base 230 is placed on an approximately horizontal surface thus positioning the glove in an approximately vertical position wherein the open end of the glove hangs down, facing base 230. Electrical wires 244 are connected to a suitable power source and switch 246 is placed in the ON position, causing electrical current to flow through heating element 240 thereby producing heat in the heating element. The heated element 240 warms the air inside tube 218 causing the air to rise and then flow into the inside of drying form 216 thereby hastening the drying process.

It is believed that the unexpected benefits which are derived from the current invention are the result of several inventive features. For example, the tube which is attached to the inside of the drying form is believed to significantly increase the air flow into the inside of the drying form by creating an upward draft of air entering into the hole of the tube (device 10, illustrated in FIGS. 1 through 3) or air entering into the open end of the tube (device 200, illustrated in FIGS. 4 and 5).

It is well known to those skilled in the art that evaporation of moisture lowers the temperature in the environment close to the evaporation site. There is thus a cooling effect inside the drying form. It is well known that lowering the air temperature results in increasing the air density. The air which is inside tube 218 has not been exposed to the temperature lowering effect of moisture evaporation occurring inside the drying form. As a result, the air inside the tube is lighter than the air inside the drying form, this causes the air in the tube to rise and to flow into the drying form thereby generating an upward air draft through the tube thus accelerating the glove drying process. Also, it is well known that moist air has a higher density than dry air, thus further enhancing the draft effect of the drying member tube. A relatively long (e.g. 6 inches) tube second length results in a greater draft effect than a relative short (e.g. 2 inches) second length.

The draft effect of the drying member tube is further enhanced by heating the air inside the tube as illustrated in drying device 200 (FIG. 6). Additionally, the glove drying process is accelerated by the warmed air flowing from tube 218 into the glove drying form. This is a non-mechanical heating process thereby avoiding the disadvantages of mechanical heating devices such as mechanical air blowers.

Air circulation inside the thumb and fingers can be improved by pipes extending from the tube into these sections thus enhancing the air flow in the fingers.

It is believed that textured exterior surfaces of drying forms of the present invention result in improved drying because the textured surfaces prevent close contact between the inside surface of a glove and the exterior surface of the drying form. This improves the evaporation rate of moisture from those portions of the glove inside surfaces which are not directly over a hole in the drying form.

Preferably, the drying members of the current invention are frequently sterilized or washed with detergents in order to inhibit the growth of microorganisms on the surfaces of the drying members.

The invention has been described in terms of the preferred embodiments. One skilled in the art will recognize that it would be possible to construct the elements of the present invention from a variety of means and to modify the placement of components in a variety of ways. While the preferred embodiments have been described in detail and shown in the accompanying drawings, it will be evident that various further modifications are possible without departing from the scope of the invention as set forth in the following claims.

I claim:

1. A device for drying gloves comprising:

a) a drying form which is adapted for receiving a glove, wherein the drying form comprises a hollow perforated body configured substantially as a human hand, including: (1) an inside surface, (2) an exterior surface opposing the inside surface, (3) a plurality of areas wherein each of the plurality of areas defines a hole, whereby the hollow body is perforated, (4) a palm portion, (5) a back of the hand portion which opposes the palm portion, (6) a thumb portion, (7) four finger portions and (8) an open end distal from the finger portions;

b) a tube affixed to the inside surface of the drying form wherein the tube comprises: (1) a first length positioned inside the drying form, (2) a second length positioned outside the drying form, (3) a first length first end which is proximal the finger portions and (4) a second length second end which is distal from the drying from open end;

c) an area defining a tube hole draft means for providing a draft in the tube in the tube second length proximate the second end, in which the tube hole has a predetermined diameter and wherein the tube hole is positioned a predetermined distance X from the tube second end; and d) a support comprising (1) a base and (2) a post which is positioned substantially perpendicular to the base, wherein the post is adapted for receiving the tube second end, in which the post has a predetermined length which is shorter than X.

2. The drying device according to claim 1 wherein the support additionally comprises:

a) a heating element mounted on the first post such that the heating element is adapted for fitting inside the tube;

b) an electrical on-off switch;

c) electrical wiring for electrically connecting the heating element to the switch; and d) electrical wiring for electrically connecting the switch to a power source.

3. A device for drying gloves, wherein the drying device is adapted for use with a support, comprising:

a) a drying form which is adapted for receiving a glove, wherein the drying form comprises a hollow perforated body configured substantially as a human hand, including: (1) an inside surface, (2) an exterior surface opposing the inside surface, (3) a plurality of areas wherein each of the plurality of areas defines a hole, whereby the hollow body is perforated, (4) a palm portion, (5) a back of the hand portion which opposes the palm portion, (6) a thumb portion, (7) four finger portions and (8) an open end distal from the finger portions;

b) a tube affixed to the inside surface of the drying form wherein the tube comprises: (1) a first length positioned inside the drying form, (2) a second length positioned outside the drying form, (3) a first length first end which is proximal the finger portions and (4) a second length second end which is distal from the drying form open end;

c) a finger holder having: (1) a tubular member which is adapted for receiving a glove covered finger portion of the drying form wherein the tubular member has: (i) a first end which is open for receiving the glove covered finger portion and (ii) a second end opposing the first end and (2) a rod member having: (i) a rod first end which is rigidly connected to the second end of the tubular member, (ii) a rod second end which opposes the rod first end and (iii) an elbow intermediate the rod first end and the rod second end wherein the elbow has a predetermined angle ranging from about 90 degrees to about 150 degrees;

d) a base; and e) a post which is mounted substantially perpendicular to the base wherein the post has a region defining a post hole having a predetermined diameter for receiving the rod second end such that the post hole is substantially parallel to the base.

4. A device for drying gloves, wherein the drying device is adapted for use with a support, comprising:

a) a drying form which is adapted for receiving a glove, wherein the drying form comprises a hollow perforated body configured substantially as a human hand, including: (1) an inside surface, (2) an exterior surface opposing the inside surface, (3) a plurality of areas wherein each of the plurality of areas defines a hole, whereby the hollow body is perforated, (4) a palm portion, (5) a back of the hand portion which opposes the palm portion, (6) a thumb portion, (7) four finger portions and (8) an open end distal from the finger portions;

b) a tube affixed to the inside surface of the drying from wherein the tube comprises: (1) a first length positioned inside the drying form, (2) a second length positioned outside the drying form, (3) a first length first end which is proximal the finger portions and (4) a second length second end which is distal from the drying form open end; and c) first pipe branching off the tube first length in which the first pipe communicates with the tube, wherein the first pipe extends into the thumb portion.

5. The drying device according to claim 4 additionally comprising a second pipe branching off the tube first length, wherein the second pipe extends into a finger portion.

6. The drying device according to claim 1 wherein the drying form comprising a plastic material.

7. The drying device according to claim 1 wherein the tube is adhesively bonded to the inside surface of the back of the hand portion.

8. The drying device according to claim 1 wherein the exterior surface is textured.

9. The drying device according to claim 1 wherein a powder coating is applied to the exterior surface of the drying form.

10. A device for drying gloves comprising:

a) a drying form which is adapted for receiving a glove, wherein the drying form comprises a hollow perforated plastic body configured substantially as a human hand, including: (1) an inside surface, (2) an exterior surface opposing the inside surface, (3) a plurality of areas wherein each of the plurality of areas defines a hole, in which the hollow body is perforated such that at least 50% of the inside surface comprises holes, (4) a palm portion, (5) a back of the hand portion which opposes the palm portion, (6) a thumb portion, (7) four finger portions and (8) an open end distal from the finger portions;

b) a tube adhesively bonded to the inside surface of the back of the hand portion of the drying form wherein the tube comprises: (1) a first length positioned inside the drying form, (2) a second length positioned outside the drying form, having a length of at least six inches, (3) a first length first end which is proximal the finger portions, (4) a second length second end which is distal from the drying form open end, and (5) a tube hole in the tube second length proximate the second end, in which the tube hole has a predetermined diameter of at least ⅛ inch and wherein the tube hole is positioned a predetermined distance X from the tube second end; and c) a support comprising: (1) a base and (2) a post which is positioned substantially perpendicular to the base wherein the post is adapted for receiving the tube second end, in which the post has a predetermined length which is shorter than X.

11. The drying device according to claim 10 wherein the support additionally comprises:

a) a heating element mounted on the post such that the heating element is adapted for fitting inside the tube;

b) an electrical on-off switch;

c) electrical wiring for electrically connecting the heating element to the switch; and d) electrical wiring for electrically connecting the switch to a power source.

12. A method for drying gloves comprising the steps of:

a) providing a drying form which is adapted for receiving a glove, wherein the drying form comprises a hollow perforated body configured substantially as a human hand, including: (1) an inside surface, (2) an exterior surface opposing the inside surface, (3) a plurality of areas wherein each of the plurality of areas defines a hole, whereby the hollow body is perforated, (4) a palm portion, (5) a back of the and portion which opposes the palm portion, (6) a thumb portion, (7) four finger portions and (8) an open end distal from the finger portions, wherein the drying form additionally has a tube affixed to the inside surface of the drying form in which the tube comprises: (i) a first length positioned inside the drying from, (ii) a second length positioned outside the drying from, (iii) a first length first end which is proximal the finger portions, (iv) a second length second end which is distal from the drying form open end and (v) an area defining a tube hole draft means for providing a draft in the tube in the tube second length proximate the second end, in which the tube hole has a predetermined diameter and wherein the tube hole is positioned a predetermined distance X from the tube second end;

b) providing a support for supporting the drying form, wherein the support comprises (1) a base and (2) a post which is positioned substantially perpendicular to the first base wherein the post is adapted for receiving the tube second end, in which the post has a predetermined length which is shorter than X;

c) inserting the post into the second length second end of the tube;

d) placing the glove on the drying form; and e) removing the glove from the drying form when the glove is dry.

13. The method of claim 12 additionally comprising the steps of:

a) providing a heating element mounted on the post such that the element is fitted inside the tube; and b) providing electrical current to the heating element.

14. The method of claim 12 additionally comprising a pipe branching off the tube first length in which the pipe communicates with the tube, wherein the pipe extends into the thumb portion.

15. A method for drying gloves comprising the steps of:

a) providing a drying form which is adapted for receiving a glove, wherein the drying form comprises a hollow perforated body configured substantially as a human hand, including: (1) an inside surface, (2) an exterior surface opposing the inside surface, (3) a plurality of areas wherein each of the plurality of areas defines a hole, whereby the hollow body is perforated, (4) a palm portion, (5) a back of the hand portion which opposes the palm portion, (6) a thumb portion, (7) four finger portions and (8) an open end distal from the finger portions, wherein the drying form additionally has a tube affixed to the inside surface of the drying form in which the tube comprises: (i) a first length positioned inside the drying from, (ii) a second length positioned outside the drying from, (iii) a first length first end which is proximal the finger portions and (iv) a second length second end which is distal from the drying form open end;

b) placing the glove on the drying form;

c) providing a finger holder having: (1) a tubular member which is adapted for receiving a glove covered finger portion of the drying form wherein the tubular member has: (i) a first end which is open for receiving the glove covered finger portion and (ii) a second end opposing the first end and (2) a rod member having: (i) a rod first end which is rigidly connected to the second end of the tubular member, (ii) a rod second end which opposes the rod first end and (iii) an elbow intermediate the rod first end and the rod second end wherein the elbow has a predetermined angle ranging from about 90 degrees to about 150 degrees;

d) inserting the glove covered finger portion into the finger holder;

e) providing a support for the drying form, wherein the support comprises (1) a base and (2) a post which is mounted substantially perpendicular to the base wherein the post has a region defining a post hole having a predetermined diameter for receiving the rod second end such that the post hole is substantially parallel to the base;

f) inserting the rod second end into the post hole;

g) removing the glove which is placed on the drying form from the finger holder when the glove is dry; and h) removing the glove from the drying form.

* * * * *